United States Patent [19]

Beck

[11] Patent Number: 4,592,215

[45] Date of Patent: Jun. 3, 1986

[54] CIRCULAR-KNITTING MACHINE

[76] Inventor: Alfred Beck, Hechinger Strasse 10, 7407 Rottenburg 21, Fed. Rep. of Germany

[21] Appl. No.: 776,986

[22] Filed: Sep. 16, 1985

Related U.S. Application Data

[63] Continuation-in-part of Ser. No. 546,898, Oct. 31, 1983, abandoned.

[30] Foreign Application Priority Data

Nov. 2, 1982 [DE] Fed. Rep. of Germany ..... 3240370

[51] Int. Cl.[4] ..... D04B 9/38; D04B 15/54

[52] U.S. Cl. ..... 66/216; 66/141

[58] Field of Search ..... 66/40, 49, 136, 141, 66/142, 216, 228

[56] References Cited

U.S. PATENT DOCUMENTS

| | | | |
|---|---|---|---|
| 525,091 | 8/1894 | Cartledge | 66/141 X |
| 1,402,394 | 1/1922 | Bosworth et al. | 66/49 |
| 2,006,821 | 7/1935 | Agulnek | 66/216 |

FOREIGN PATENT DOCUMENTS

| | | | |
|---|---|---|---|
| 3119 | of 1914 | United Kingdom | 66/49 |
| 132357 | of 1960 | U.S.S.R. | 66/40 |

*Primary Examiner*—Wm. Carter Reynolds

[57] ABSTRACT

A thread guide has a front edge that is inclined relative to the running direction of the needles, a first thread guide hole for a thin back thread and a second thread guide hole for a thick pattern thread. The needles are movable along a knitting curve which has a first partial zone which lies in front of the front edge of the thread guide, which includes the needle latch opening zone, and a second partial zone which lies behind the thread guide. A knitting position adjoins the knitting curve. For a thin back thread, a first withdrawal curve follows the knitting position, a thread insertion position follows the first withdrawal curve, and a third withdrawal curve follows the thread insertion position and extends to a knocking-over position disposed beneath the knocking-over edge. For a thick pattern thread, a second withdrawal curve extends from a thread reception position at a greater angle to the knocking-over edge than the third withdrawal curve.

18 Claims, 13 Drawing Figures

CIRCULAR-KNITTING MACHINE

Figure 1:
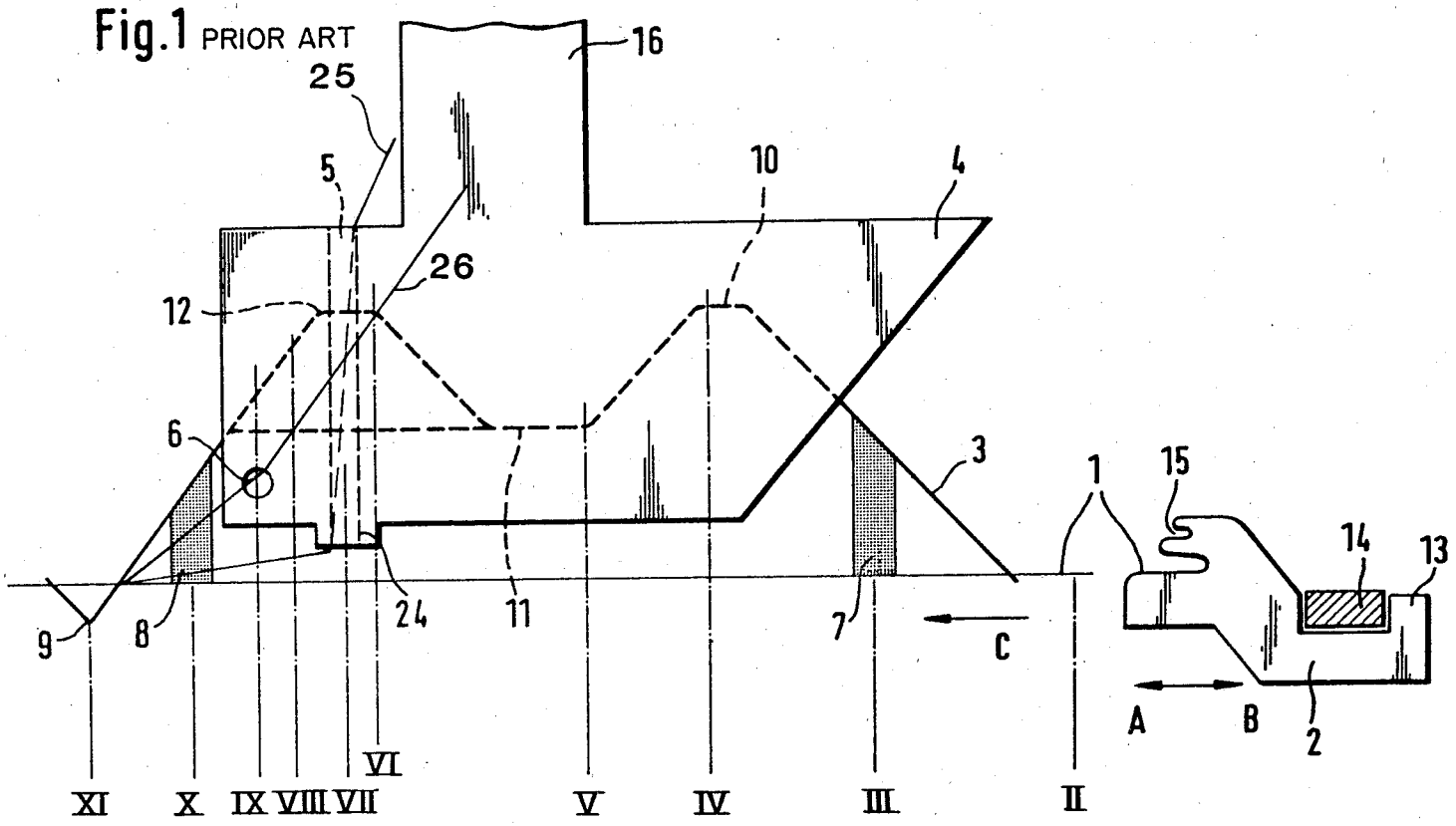
Fig.1 PRIOR ART

This is a continuation-in-part of U.S. patent application Ser. No. 546,898, filed Oct. 31, 1983, of the same inventor, now abandoned.

The invention relates to a device as described in the introductory part of the main claim.

Such a circular-knitting machine for mesh or eyelet-stitch patterns is known by the trademark name of Louvnit. The 24 inch machine has 32 knitting systems, the 26 inch machine has 36 knitting systems, and the 30 inch machine has 40 knitting systems. It allows fabrics for, for example, underwear to be produced. The machine works with a thick thread which by itself provides the appearance of the material, whereas the thin thread is so thin that one can only discern it when looking very closely and if one's eyesight is good. With the known machine it is not possible that the thin thread will also form mesh loops. On the contrary, the knitting system is such that one can only form stitches therewith. In this knitting system, the thick thread is grasped and formed into stitches only by needles which are used for the pattern in the form of needles of varying length with their associated cam tracks or by way of pattern devices such as pattern wheels, selecting plates, jacquard drums or perforated steel bands. Needles which were not selected for the stitch formation do not form any stitches with the thick thread and leave in the knitted fabric a float which has an open-work-like appearance and, if the arrangement is diagonal, looks like a fishing net. In the case of the conventional machines, the basic principle for the production of the aforementioned open-worked plain/purl fabric is attained in that in each knitting system all the needles are driven into the knitting position, causing the old stitch already formed to come to lie beneath the needle latch on the needle shank. Following this needle position, the needles are guided downwards so that the spoon of the needle latch comes to lie somewhat beneath the knocking-over edge. The old stitch is then situated on the needle shank behind the spoon of the opened needle latch. The needles are selected from this position for the pattern formation by lifting. Needles which are intended to form with the thick thread not a stitch but only a float are lifted by a pattern wheel provided for this purpose. At the same time, the thick thread is brought against the needle shank beneath the opened latch with the aid of the knocking-over sinkers so that, during the following downward movement, the thick thread slides over the closing needle latch and cannot pass into the needle hook. The thread drops over the needle head and forms a float in the plain/purl knit fabric. At the same time, a thin thread is fed to all the needles for the preceding operation and, irrespective of the selection made, a stitch is formed with the thin thread by all the needles.

Due to the number of the knitting systems provided per inch in diameter, the capacity of this circularknitting machine is limited. The thread guide is very large and complicated. It covers parts which have to be accessible when a thread has broken so as to re-feed the thread. Because the thread guide has an oriel on its lower edge, so as to allow the thick thread to be fed correctly, the knocking-over sinkers have to be moved radially by an additional working stroke so that they can avoid the oriel. The knocking-over sinker is complicated in that it has to have at the top an additional throat for the thick pattern thread. The deflection angles for the two threads into the thread guide and out of the thread guide are unfavourable so that fluff is formed by the constant scraping and furthermore the thread guide holes are more easily serrated by the threads. The insertion of the threads into the needle is not effected with the desired reliability.

It is the object of the invention to indicate a machine of the kind mentioned at the beginning which can have considerably more knitting systems per inch in diameter and which nevertheless provides much better access to the various sinkers of the knitting systems and which allows mesh loops to be formed with the thin thread, too, if desired, thus allowing the appearance of the knitted fabric to be varied in an improved manner.

According to the invention, this problem is solved by the following features:

(a) Following the needle latch opening zone, the knitting curve, branching off for the needles catching the thin back thread, change to a catching position which starts not further downstream than the front edge and has a horizontal component and changes to the thread insertion position, the old stitch, consisting of the back thread and the pattern thread, in the catching position still being disposed on the downwardly hanging latch of the needle.

(b) The knitting position of the needles which have the task of knitting the pattern thread extends substantially in a horizontally continuous plateau-like manner to the second withdrawal curve which extends substantially at a first angle to the knocking-over edge.

(c) The thread insertion position changes to a third withdrawal curve which leads to the knocking-over position and extends substantially at a second angle to the knocking-over edge, which angle is considerably smaller than the first angle (to such an extent that the back thread needles do not grasp the pattern thread).

Advantageously, the invention includes the following additional features:

The first thread guide hole is beneath the third withdrawal curve.

The first thread guide hole is close to the rear edge.

The first thread guide hole extends obliquely from the top of the bottom.

The first thread guide hole also extends obliquely in the running direction of the needles.

The second thread guide hole is above the first guide hole and in front of the second withdrawal curve.

The second thread guide hole is below the knitting position.

The second thread guide hole is above the thread insertion position.

The second thread guide hole is in the sector between the second and third withdrawal curves.

The knitting position changes, close to the rear edge, into the second withdrawal curve.

The lower edge of the thread guide is without a projection.

The first angle is between 50°–55°.

The first angle is 53°.

The second angle is between 42°–46°.

The second angle is 45°.

The first withdrawal curve meets the second withdrawal curve on the knocking-over edge and from there jointly leads to the knocking-over position.

The knocking-over sinker only has a throat which extends from the knocking-over edge.

The ratio of the knitting systems to the diameter of the needle cylinder of the circular-knitting machine is greater than 1.5.

The invention will be understood best if the prior art is outlined in detail. For this reason, a detailed description of the prior art will be given to begin with and only then a description of the invention. In principle, the same means are used for controlling the knocking-over sinker and the needles as in the prior art, and they are therefore not described separately. Words formed with "position" indicate that the state of the needles has a tendency towards rest for a specific period of time. Ideally, the needle then does not move for that time or does so only to a very slight extent. By contrast, the word "curve" signifies that the needles mainly carry out upward or downward movements.

Figure 10:
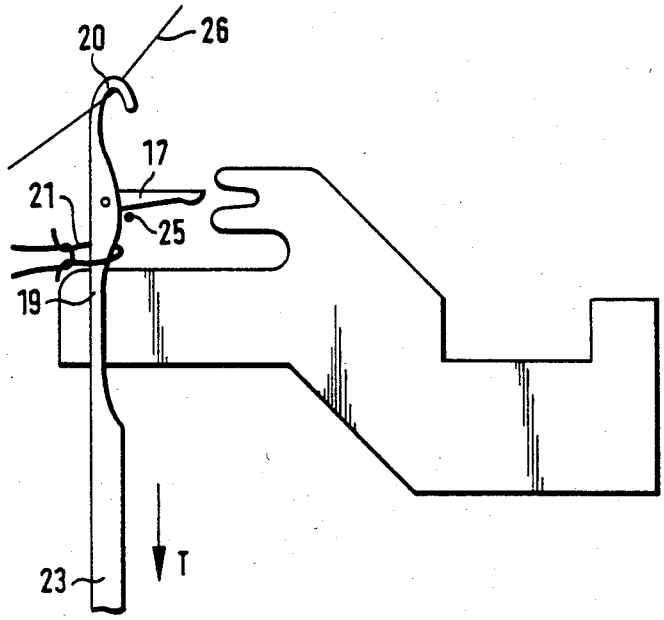
Fig. 10 PRIOR ART
Figure 11:
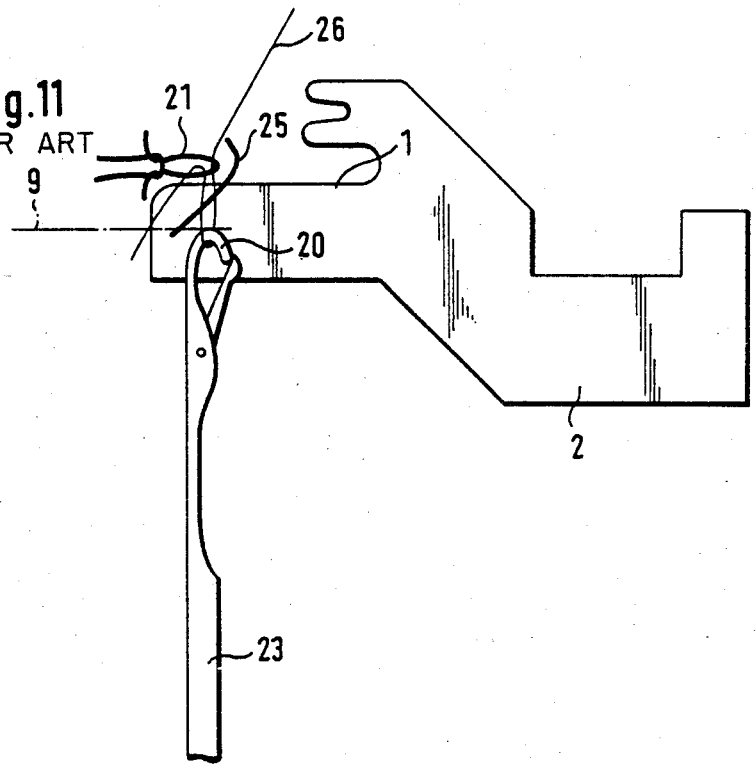
Fig. 11 PRIOR ART
Figure 12:
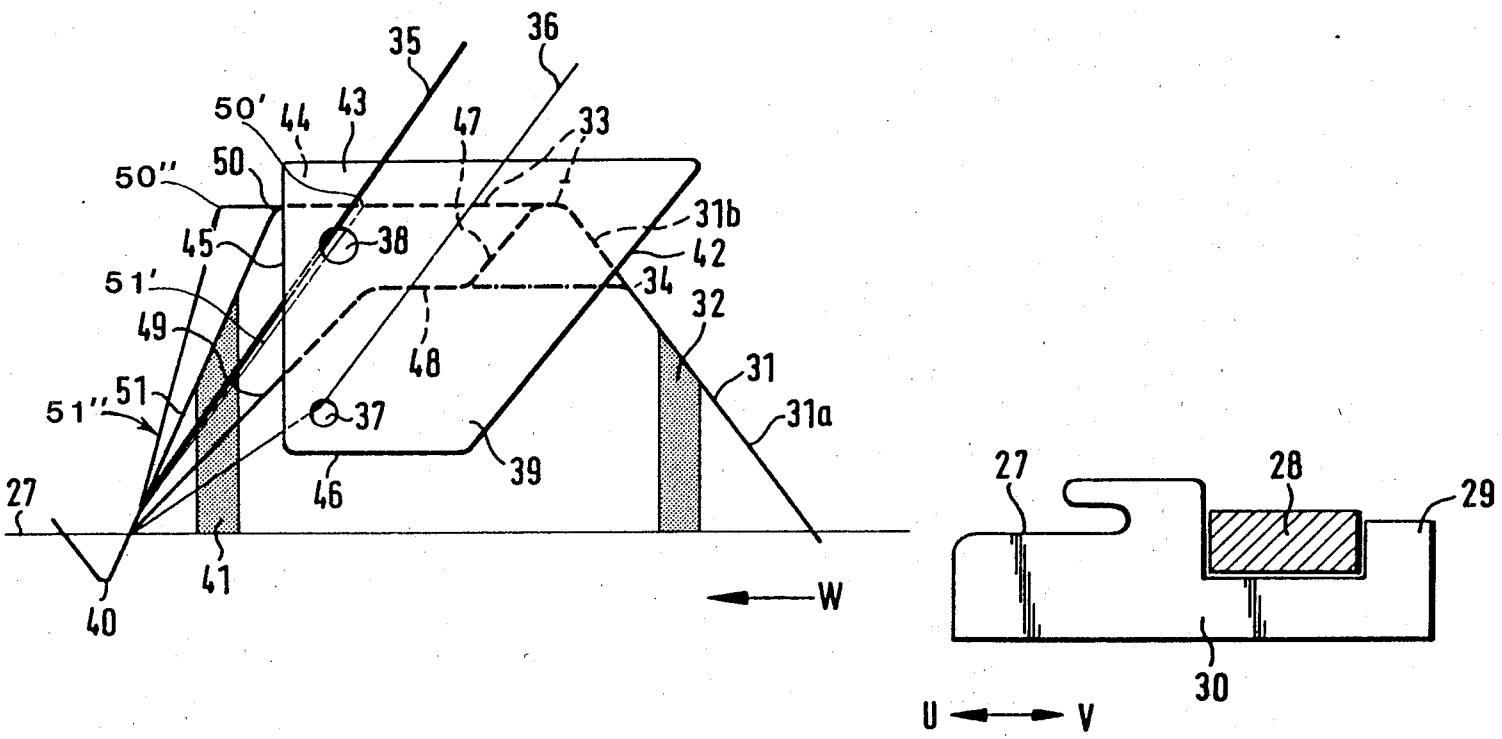
Figure 13:
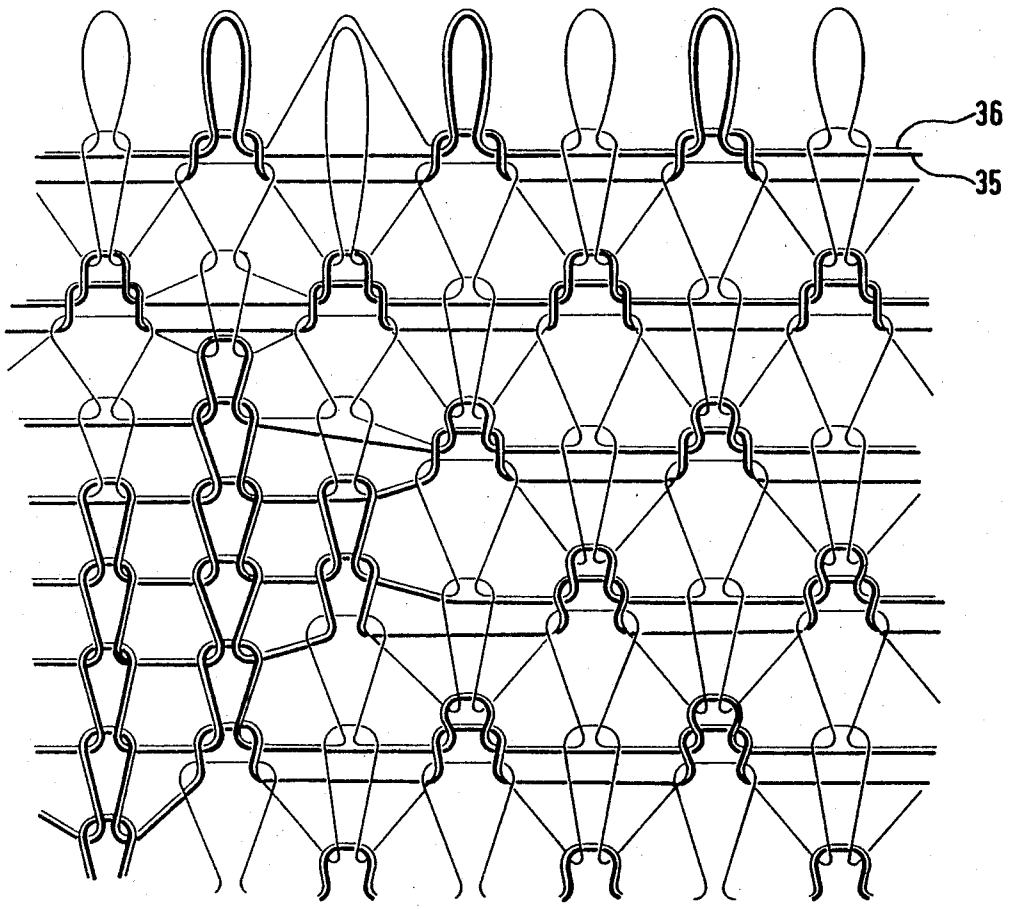

In the drawings:

FIG. 1 shows the curve behaviour of the needles together with an outer view of the thread guide as well as the associated knocking-over sinker with the sinker cam according to the prior art, FIGS. 2 to 11 show further states of the prior art knitting system indicated in FIG. 1., FIG. 12 shows a representation of the preferred exemplified embodiment according to the invention, in the same mode of representation as that of FIG. 1, and FIG. 13 shows a representation of the knitted fabric produced according to the invention but wherein, so as to clearly illustrate the mesh-loop formation, there has been fed instead of the thin thread a thick black thread, so that one can see it without any great effort.

FIG. 1 shows the knitting curve 3 of the needles for the stitch formation operation of the thin back thread 26 and of the thick pattern thread 25 within a knitting system. The arrow C in the direction from right to left indicates the running direction of the needles, considered from the outside of the machine in the direction of the machine centre. The thread guide 4 is stationary. The needles pass behind the thread guide.

The stitch formation is effected on the knocking-over edge 1 of the knocking-over sinkers 2. The knocking-over sinkers 2 are moved by sinker cams 14 in the direction of the arrows A, B; towards the machine centre in the direction A and away from the machine centre in the direction B. These movements are rendered possible by a sinker butt 13. The knocking-over sinkers 2 are mounted in a radially slotted ring not shown.

Figure 2:
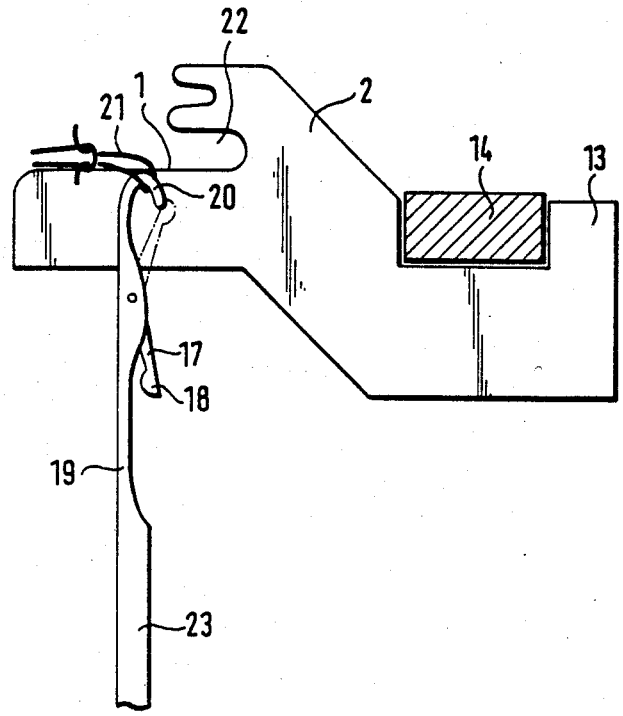
Fig. 2 PRIOR ART

FIG. 2 is a section on the dash-dotted line II of FIG. 1. The needle 23, with its hook 20, is so positioned relative to the knocking-over sinker 2 that the old stitch 21 is disposed on the level of the knocking-over edge 1. The latch 17 may be opened or closed in this position.

Figure 3:
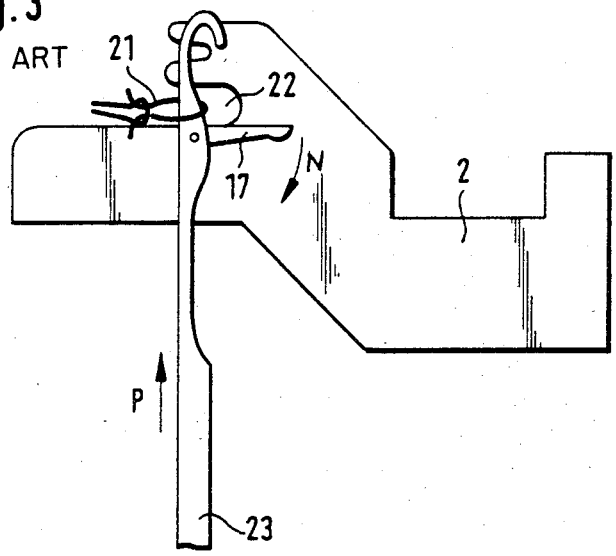
Fig. 3 PRIOR ART

FIG. 3 is a section on the dash-dotted line III of FIG. 1. The opening of the needle latches is effected in the hatched panel 7. During this upward movement in the direction of the arrow P, the latch 17 with its spoon 18 is opened, that is to say is moved in the direction of the arrow N, by the old stitch 21. During the upward movement, the old stitch 21 is held down by the throat 22 of the knocking-over sinker 2. To this end, the knocking-over sinker 2 has carried out a short movement in the direction of the machine centre.

Figure 4:
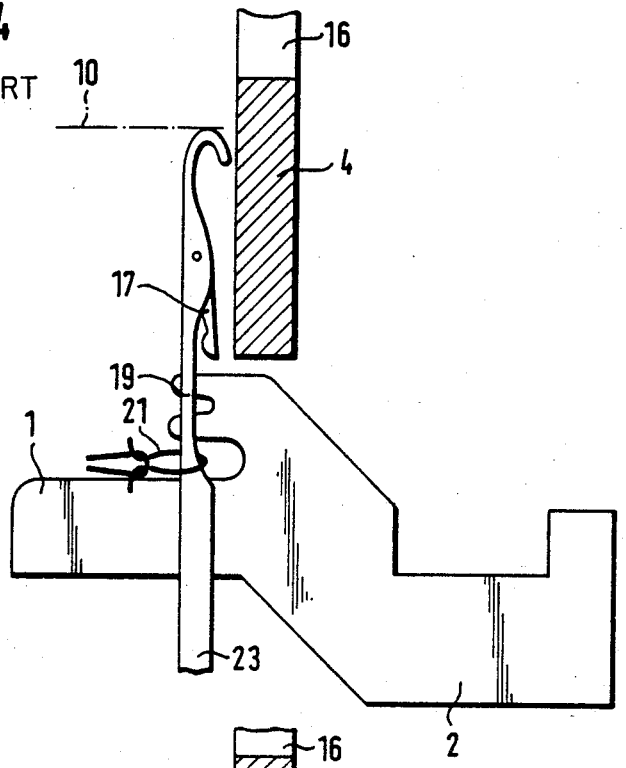
Fig. 4 PRIOR ART

FIG. 4 is a section on the dash-dotted line IV of FIG. 1. The needle 23 has reached the latch clearing position 10. The old stitch 21 is disposed on the knocking-over edge 1 of the knocking-over sinker and the shank 19 of the needle 23. In order to prevent the latch 17 from being closed, the stationary thread guide 4 has been positioned close to the opened needle 23. The thread guide 4 is fastened to a thread guide carrier 16.

Figure 5:
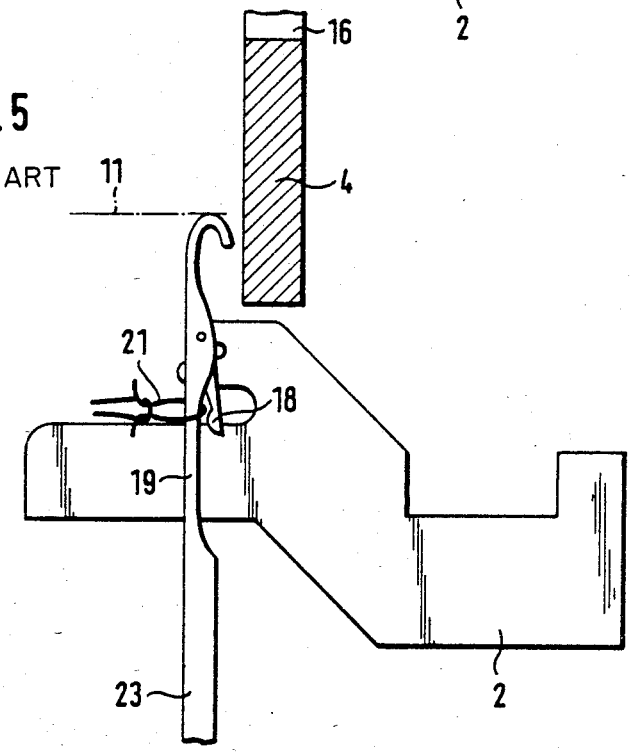
Fig. 5 PRIOR ART

FIG. 5 is a section on the dash-dotted line V of FIG. 1. The needle 23 has been withdrawn in the downward direction to the thread insertion position 11. The old stitch 21 is disposed on the shank 19 of the needle 23 and beneath the spoon 18. The needles are selected from this position for the pattern formation, the needles for the reception and stitch formation of the thick pattern thread remaining in the thread insertion position 11, whereas the needles used for the pattern formation are passed upwards again to the thread reception position 12. The selection of the needles intended for the pattern formation may be effected by devices suitable for this purpose such as pattern wheels, pattern drums or other known devices.

Figure 6:
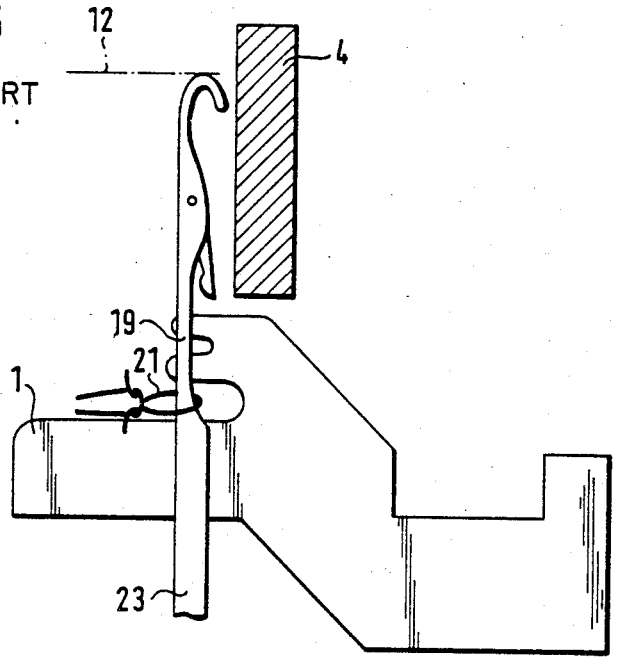
Fig. 6 PRIOR ART

FIG. 6 is a section on the dash-dotted line VI of FIG. 1. The needles which have not been selected for the pattern formation remain in the thread insertion position 11, as shown in FIG. 5. This thread insertion position cannot be seen in FIG. 6 since the needle which is in this position is concealed by the needle which is in the thread reception position 12. The needle 23 has been moved so far to the top that the old stitch 21 lies on the shank 19 of the needle 23 and on the knocking-over edge 1 of the knocking-over sinker 2.

Figure 7:
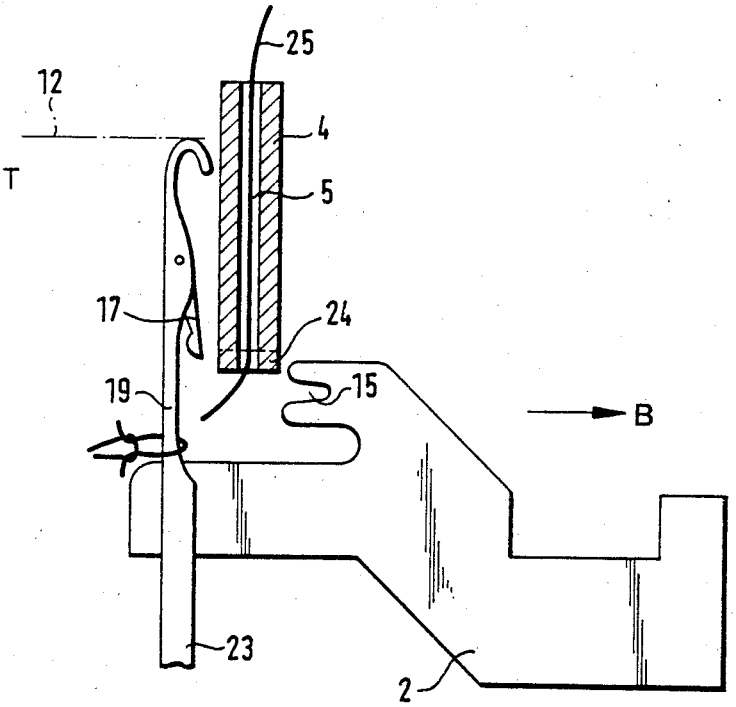
Fig. 7 PRIOR ART

FIG. 7 is a section on the dash-dotted line VII of FIG. 1. The needle 23 disposed in the thread reception position 12 receives at this point its thick pattern thread 25 which is taken to the shank 19 through the thread guide hole 5 beneath the latch 17. For this purpose, the thread guide 4 has an oriel 24 on its underside so that the thick thread can be reliably passed into the throat 15. The knocking-over sinker 2 has been displaced for this purpose somewhat to the right in the direction B, in other words away from the machine centre.

Figure 8:
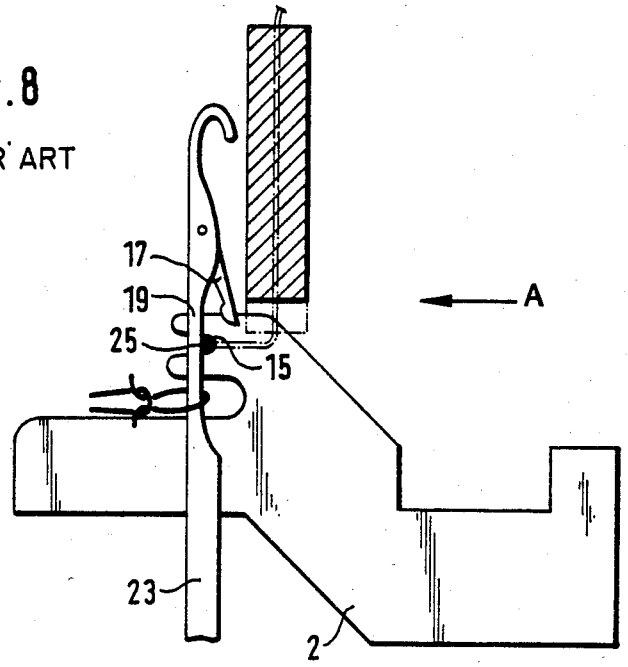
Fig. 8 PRIOR ART

FIG. 8 is a section on the dash-dotted line VIII of FIG. 1. In this position, the knocking-over sinker 2 has been moved in the direction of the arrow A to the left towards the machine centre so that the pattern thread 25 is grasped by the throat 15 and bears against the shank 19 of the needle 23. By this means, the pattern thread 25 reliably stays beneath the latch 17 and has to slide over the closing latch. This thread cannot form a stitch and appears as a float in the knitted fabric.

Figure 9:
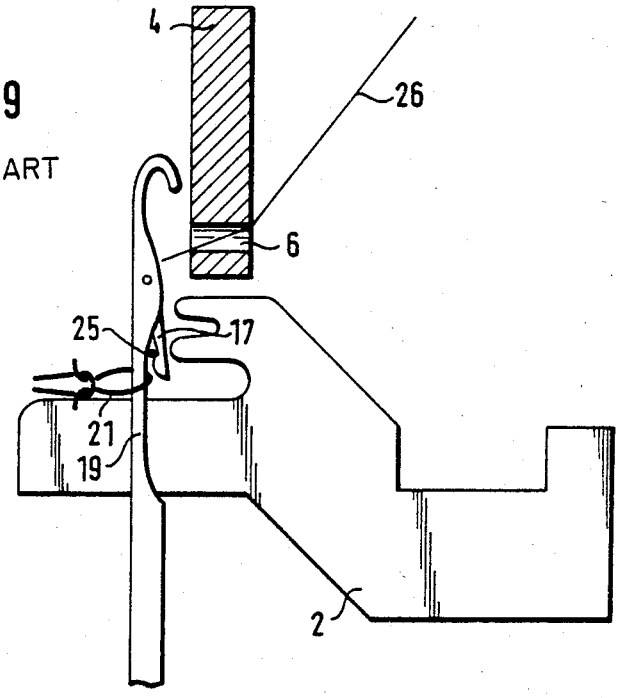
Fig. 9 PRIOR ART

FIG. 9 is a section on the dash-dotted line IX of FIG. 1. At this point, all the needles receive the thin back thread 26 which is fed here, irrespective of whether or not they have been selected for the pattern formation, and form stitches therefrom. The pattern thread 25 lies on the shank 19 beneath the latch 17. The old stitch 21 is also disposed on the shank 19 and beneath the latch 17. The thin back thread 26 is taken through the thread guide hole 6 to the opened latch.

FIG. 10 is a section on the dash-dotted line X of FIG. 1. The closing of the needle latches is effected in the hatched panel 8. The pattern thread 25 disposed on the shank 19 and the old stitch 21 close the latch 17 during the downward movement of the needle 23 in the direction of the arrow T. The thin back thread 26 passes into the hook 20 during this process.

FIG. 11 is a section on the dash-dotted line XI of FIG. 1. In this position, the needle 23 is in the knocking-over position 9. The back thread 26 is drawn through the old stitch 21 and by this means a new stitch is formed. During this process, the hook 20 is taken beneath the knocking-over edge 1 of the knocking-over sinker 2 to the so-called knocking-over position 9. At the same time, the pattern thread 25 is dropped over the hook 20 during this stitch formation process with the back thread 26 and appears as a float in the knitted fabric.

The afore-described process relating to knitting technology constitutes the prior art and only allows a course to be formed with the thin back thread 26.

On account of its special needle guidance, the machine on which the invention is based allows stitches and mesh loops to be formed within a course. This renders possible additional pattern variations since stitches, mesh loops and floats can appear in the same knit fabric part.

Furthermore, according to the present state of the art, the needle has to travel long distances in order to attain the afore-mentioned pattern technique. Until now, there were attained, despite a compact construction, less than 1.5 times as many knitting systems as the diameter of the machine in inches. The present invention renders possible, due to a simplified needle guidance, not only the formation of stitches and mesh loops in a row but also the accommodation of three times the number of knitting systems as the diameter of the machine in inches. This means that the capacity of the machine can be increased by more than 100%.

FIG. 12 shows the needle guidance in a knitting system according to the present invention. The needles pass through the cam assembly in the direction of the arrow W from right to left. 31 represents the knitting curve, analogously to the knitting curve 3 of FIG. 1. In the hatched panel 32 there is effected, as in the panel 7 of FIG. 1, the opening of the needle latches by the stitches disposed on the needles. A first partial zone 31*a* on the knitting curve 31 lies in front of the front edge 42. A second partial zone 31*b* lies behind the thread guide 39. A short distance in front of the front edge 42, which extends approximately at 45°, of the thread guide 39, there commences the substantially horizontal catching position 34. As regards the level of the needles, this position is at the tuck level and equals the thread insertion position of FIG. 5, but there is disposed on the latch that stitch which has been cast off downwardly in FIG. 5. The broken line 33 corresponds to the latch clearing position. The catching position 34 is at least partly concealed and the latch clearing position 33 is completely concealed by the thread guide 39, thus preventing the latches from closing. The thread guide 39 has a front 43 and a rear 44. Of course, in the invention, the needles are just as close to the rear 44 of the thread guide 39 as they are in the prior art.

For the needles which have the task of knitting the back thread 36, the knitting position is only a small fraction of the total length of the knitting position, as shown in FIG. 12. There then follows, as shown in FIG. 12, the withdrawal curve 47 at an angle of approximately 50°. This is followed by the substantially horizontal thread insertion position 48 which, as regards the level, is equal to the catching position 34. As regards the position of the needle and the position of the stitches, the thread insertion position is the same as that in FIG. 5.

Depending on the antecedent, there are thus disposed on the section 48 either needles where the stitch is disposed beneath the latch. In this case, they come from the knitting position 33. Or else there run in that section needles which, prior to reaching the latch clearing position 33, have been directed to the catching position 34 and where the stitch lies on the latch. As shown in FIG. 12, the end of the thread insertion position 48 is positioned so far to the right of the rear edge 45 that there can commence behind the thread guide 39 a withdrawal curve 49 for the needles knitting the back thread 36.

The needles which have the task of knitting the pattern thread 35 remain in the latch clearing position 33 and only after a thread reception position at radius 50 proceed into their withdrawal curve 51. Sometimes, the withdrawal curve, shown as 51', may proceed after a radius 50' that lies behind the rear 44 of the thread guide. Also, sometimes, the withdrawal curve, shown as 51", may proceed after a radius 50" that lies fully after the rear edge 45. Thus, the withdrawal curve lies at most partly behind the rear 44 of the thread guide. The withdrawal curve always lies at least in a part of the needle latch closing zone 41, which zone is disposed after the rear edge 45 of the thread guide, and after the thread insertion position 48.

In the thread guide 39, there is provided at the top on the left-hand side a hole 38, which extends from the oblique top right-hand side to the oblique bottom left-hand side, for the thick pattern thread 35. At the bottom left-hand side, there is provided in the thread guide 39 a hole 37, which extends from the oblique top right-hand side to the oblique bottom left-hand side which is in the running direction of the needles, for the thin back thread 36.

The upward and downward movements of the needles and the stitch formation taking place during this process is supported in known manner by the knocking-over sinkers 30 on the knocking-over edge 27. The knocking-over sinkers 30 carry out horizontal movements in the direction of the arrows U–V by means of the sinker cam 28 and the sinker butt 29. U means the direction towards the machine centre and V means the direction from the machine centre.

When the needles have passed through the cam assembly, either in the catching position 34 for grasping the back thread 36 or in the latch clearing position 33, also for grasping the back thread 36, it is possible to form in a course stitches and mesh loops in accordance with the pattern.

A stitch formation and thread float in a course in accordance with the pattern is also possible, in that the needles are moved from the latch clearing position 33 for grasping the back thread 36 to the catching position, and as a result the pattern thread 35 cannot be grasped and there is formed a thread float. Or else the needle remains in the latch clearing position 33 and forms a stitch with the pattern thread 35.

The selection of the needles for catching or knitting the back thread 36 and for knitting and floating the pattern thread 35 is effected by suitable pattern devices which will not be described in detail herein.

The needles coming from the latch clearing position 33 and the catching position 34 or the thread insertion position are guided along angles, which differ in steepness, of two stitch cams in such a way that the needles coming from the latch clearing position follow a steeper path in the downward direction and the needles coming from the catching position or the thread insertion position follow a flatter path. The former follows an angle of between 50°–55°, preferably 53°. The latter follows an angle of 45°. Due to the fact that the pattern thread 35 is threaded into the upper thread guide hole 38, it can only be grasped by the needles which come from the level of the knitting position.

The back thread 36 is grasped by all the needles and forms either stitches or mesh loops in accordance with the pattern selection. Due to the withdrawal angles of the withdrawal curves 49, 51 of different steepness, a reliable separation of the pattern thread and the back thread is possible. The withdrawal angle of the withdrawal curve 49 is between 42°–46° and is at 45° to the knock-over edge 27 in this embodiment. The withdrawal angle of the withdrawal curve 51 is between 50°–55° and is at 53° in this embodiment.

The needles of different withdrawal angles meet on the level of the knocking-over edge 27 and are withdrawn to the knocking-over position 40 at a common withdrawal angle. At 41, the needle latches are closed by the old stitches and the new threads are grasped. During this process, the pattern thread 35 passes as a float behind all the needles which are withdrawn at a flat withdrawal angle.

When comparing FIGS. 1 and 12, one sees that the invention renders possible a larger number of knitting systems than the prior art. The ratio of the knitting systems of the invention to the diameter of the needle cylinder of the circular knitting machine is greater than 1.5. One furthermore sees that second upward and downward movements of the needles on either side of the thread guide hole 6 are not necessary and the machine thus runs more quietly, the needles last longer and the associated control equipment can be produced in a simpler manner. The comparison of FIG. 1 with FIG. 12 also shows that the throat 15 of the knocking-over sinker in FIG. 1 has been dispensed with in the knocking-over sinker 30 and the knocking-over sinker is thus also simpler. In the invention, there is no need for the movement of the knocking-over sinker shown in FIG. 7, by means of which movement the sinker avoids the oriel 24.

I claim:

1. A device for a circular-knitting machine for the production of a plain fabric, having a thread guide which has a front edge that is inclined relative to the running direction of the needles, a front, a rear, a rear edge, a lower edge, a first thread guide hole which is provided for a thin back thread, and a second thread guide hole which is provided for a thick pattern thread; and having a knocking over sinker with a knocking over edge, a sinker cam for moving the knocking over sinker, which is movable radially in a reciprocatable manner, a knitting curve which rises in the direction of movement of needles, the knitting curve having a first partial zone which lies in front of the front edge of the thread guide, in which zone there is disposed a needle latch opening zone, the knitting curve having a second partial zone which lies behind the thread guide; and having a latch clearing position which adjoins the knitting curve, which has a component that is parallel to the direction of movement and a thread reception position for the pattern thread; and having a first withdrawal curve which follows the latch clearing position, a thread insertion position which follows the withdrawal curve, a second withdrawal curve which follows the thread reception position and is after the thread insertion position and extends to the knocking-over position disposed beneath the knocking-over edge; and having a needle latch closing zone disposed after the rear edge of the thread guide, the second withdrawal curve lying at most partly behind the rear of the thread guide and at least in a part of the needle latch closing zone, comprising the improvement wherein:

(a) following the needle latch opening zone, the knitting curve, branching off for the needles catching the thin back thread, changes to a catching position which starts not further downstream than the front edge and has a horizontal component and changes to the thread insertion position, the old stitch, consisting of the back thread and the pattern thread, in the catching position still being disposed on the downwardly hanging latch of the needle, (b) the latch clearing position of the needles which have the task of knitting the pattern thread extends substantially in a horizontally continuous plateau-like manner to the second withdrawal curve, which extends substantially at a first angle to the knocking-over edge, and (c) the thread insertion position changes to a third withdrawal curve which leads to the knocking-over position and extends substantially at a second angle to the knocking-over edge, which angle is considerably smaller than the first angle to such an extent that the back thread needles do not grasp the pattern thread.

2. A device as claimed in claim 1, wherein the first thread guide hole is beneath the third withdrawal curve.

3. A device as claimed in claim 2, wherein the first thread guide hole is close to the rear edge.

4. A device as claimed in claim 1, wherein the first thread guide hole extends obliquely from the top to the bottom.

5. A device as claimed in claim 1, wherein the first thread guide hole extends obliquely in the running direction of the needles.

6. A device as claimed in claim 1, wherein the second thread guide hole is above the first thread guide hole and in front of the second withdrawal curve.

7. A device as claimed in claim 1, wherein the second thread guide hole is below the latch clearing position.

8. A device as claimed in claim 1, wherein the second thread guide hole is above the thread insertion position.

9. A device as claimed in claim 1, wherein the second thread guide hole is in the sector between the second and third withdrawal curves.

10. A device as claimed in claim 1, wherein the latch clearing position changes, close to the rear edge, into the second withdrawal curve.

11. A device as claimed in claim 1, wherein the lower edge of the thread guide is without a projection.

12. A device as claimed in claim 1, wherein the first angle is between 50°–55°.

13. A device as claimed in claim 12, wherein the first angle is 53°.

14. A device as claimed in claim 1, wherein the second angle is between 42°–46°.

15. A device as claimed in claim 14, wherein the second angle is 45°.

16. A device as claimed in claim 1, wherein the third withdrawal curve meets the second withdrawal curve on the knocking-over edge and from there jointly leads to the knocking-over position.

17. A device as claimed in claim 1, wherein the knocking-over sinker only has a throat which extends from the knocking-over edge.

18. A device as claimed in claim 1, wherein the ratio of the knitting systems to the diameter of the needle cylinder of the circular-knitting machine is greater than 1.5.

* * * * *